US006929383B1

(12) United States Patent
Janning

(10) Patent No.: US 6,929,383 B1
(45) Date of Patent: Aug. 16, 2005

(54) SEMICONDUCTOR CHIP AND CONDUCTIVE MEMBER FOR USE IN A LIGHT SOCKET

(76) Inventor: John L. Janning, 332 Vindale Dr., Dayton, OH (US) 45440

( * ) Notice: Subject to any disclaimer, the term of this patent is extended or adjusted under 35 U.S.C. 154(b) by 157 days.

(21) Appl. No.: 10/611,744

(22) Filed: Jul. 1, 2003

(51) Int. Cl.[7] ..... F21V 23/00; H05B 37/00

(52) U.S. Cl. ..... 362/234; 315/122; 315/185 R

(58) Field of Search ..... 315/121, 122, 315/129, 185 R, 185 S, 192, 312, 324; 362/227, 362/234, 249, 251

(56) References Cited

U.S. PATENT DOCUMENTS

| | | | | |
|---|---|---|---|---|
| 2,072,337 A | * | 3/1937 | Kamm | 315/122 |
| 3,345,482 A | * | 10/1967 | Lou | 315/122 |
| 4,727,449 A | * | 2/1988 | Fleck | 315/122 |
| 4,769,579 A | * | 9/1988 | Jou | 315/201 |
| 5,442,258 A | * | 8/1995 | Shibata | 315/129 |
| 5,854,541 A | * | 12/1998 | Chou | 315/185 R |
| 6,084,357 A | | 7/2000 | Janning | |
| 6,580,182 B2 | | 6/2003 | Janning | |

* cited by examiner

*Primary Examiner*—Alan Cariaso
(74) *Attorney, Agent, or Firm*—R. William Graham

(57) ABSTRACT

A shunt device for a light socket includes a semiconductor chip which is operably interposed between a pair of electric terminals of the socket. The sockets are in series for a conventional set of display lights, such as holiday lights.

15 Claims, 6 Drawing Sheets

SEMICONDUCTOR CHIP AND CONDUCTIVE MEMBER FOR USE IN A LIGHT SOCKET

FIELD OF INVENTION

The present invention relates to a lamp socket for light strings having lights arranged in series. More particularly, the invention relates to a semiconductor chip and conductive member for use in a light socket forming a shunt to allow for electricity to continually conduct throughout the light string keeping the remainder of the lights lit when one or more lights on the string burn out, become dysfunctional or are removed from a socket.

BACKGROUND OF THE INVENTION

Decorative light strings which are connected in series are highly popular in the United States, especially during holidays in November and December. A drawback with such light strings is that they commonly include of a plurality of individual light units with bulbs which are electrically connected in series and not in parallel. The bulbs are typically incandescent bulbs having a filament formed between two leads of the bulb, the filament giving off light when a current is passed from one lead to the other, through the filament. As the bulb is used, over time, the filament will burn out, breaking the series circuit in which the bulb is arranged. This will cause the entire light string to go out unless a backup circuit path is available to bypass the failed filament. Presently, inside of the mini-light bulb, there is a backup circuit path having a shunt system arranged in parallel with the filament of each bulb. This shunt is comprised of three turns of aluminum wire with an insulating (oxide) coating. When the filament is intact, current passes through the filament because the resistance of the filament is low compared to that of the insulating material on the shunt. However, when the filament burns out, the voltage across the leads of the bulb increases to the full line potential of 120 volts AC. The actual peak voltage at 120 volts AC is approximately 170 volts. The insulating coating on the shunt wire is designed to break down at a minimum of 40 volts to provide a backup circuit path around the failed filament. However, this 'shorting' mechanism only works about 70% of the time. When it fails to operate, the entire series-wired light string goes out.

One solution that allows the circuit to continue to function when there is a failure as described above is taught in U.S. Pat. Nos. 6,084,357 and 6,580,182 which is issued to the same inventor herein. The solution is to provide a backup circuit path having a semiconductor shunt system arranged in parallel with the filament of each bulb. As described in the above mentioned issued patents, the semiconductor device might be a diode array or back-to-back Zener diodes. In this manner, even if a bulb burns out, breaks, or falls out of its socket, the rest of the light units in the light string remain on because the series circuit remains closed.

The system employed in the above issued patents is the shunting of each light bulb in the string with such a semiconductor shunt mounted in a package as the standard DO-41 package. The DO-41 package housing the semiconductor chip is placed inside of each socket and is electrically connected to the light bulb's conductive connection in the socket.

While the availability of decorative light strings using this type of shunt works well, there remains a need to improve shunts as set forth herein. Further, there is need to decrease the cost of producing the decorative light string.

BRIEF SUMMARY OF THE INVENTION

It is an object to improve decorative light strings.

It is another object to reduce the cost of decorative light strings.

It is a further object to provide a semiconductor chip inside of a light socket without the need for a separate housing such as the DO-41 package.

Accordingly, an embodiment of the present invention is directed to a shunt device for use in a light socket having a semiconductor chip held in place by a spring-like tension conductive member. Another embodiment provides for the chip to be held in place by conductive leads having terminal ends which plug into electric terminals of the sockets. Still another embodiment is directed to a bent conductive member having the chip sandwiched between a pair of conductive terminals with bias toward one another to retain the same by the conductive terminals. In yet another embodiment, the conductive terminals can be modified to include retention fingers which are opposing each other in a spaced relationship in a manner to form a retaining seat for the chip which can be preferably sandwiched in between. Still another embodiment provides for a chip to be directly connected to each conductive terminal and have a conductive wire interconnecting the two chips, wherein each chip is intended to dissipate half of the power keeping the socket from overheating in cases where too much current is drawn, such as when higher watt light bulbs are used.

The light socket of the instant invention is for use with a light string having at least two light sockets connected in series via wire segments having associated contact elements. A light bulb is receivable by each socket and can be removed and replaced when a filament of the bulb burns out.

Other objects will be revealed by the following description and drawings.

DETAILED DESCRIPTION OF THE PREFERRED EMBODIMENT

Figure 1:
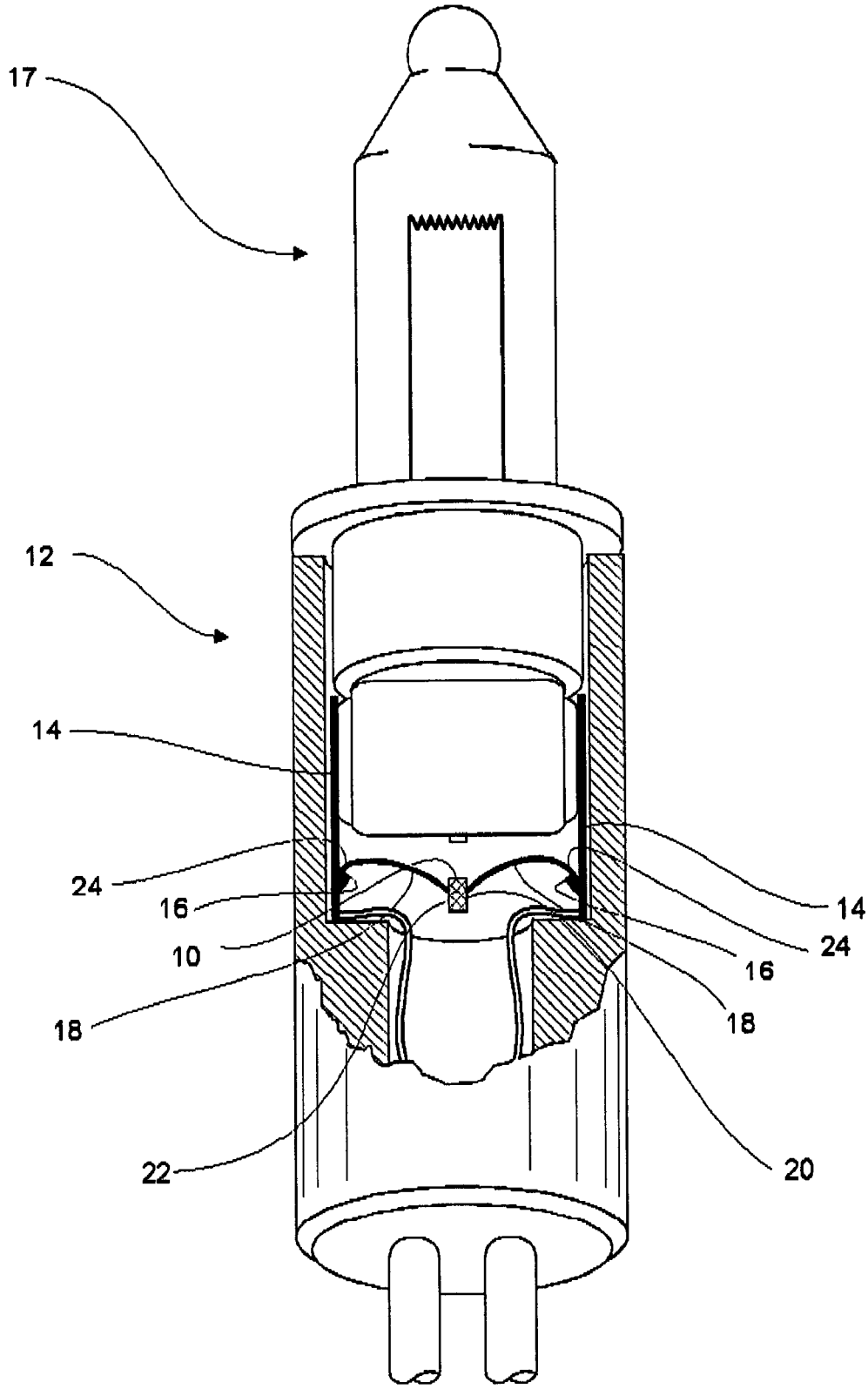
FIG. 1 is a partial sectional view of one embodiment of the invention.

Referring now to the drawings, the semiconductor chip of the present invention is generally designated by the numeral 10. The semiconductor chip 10 is a relatively flat and thin plate which is of the type described in U.S. Provisional Patent Application No. 60/471,094. The chip 10 is used in various embodiments described herein.

FIG. 1 shows a modified light socket 12 having conductive terminals 14 on each side with plug-in socket surfaces 16 formed therein in a portion of each terminal 14 where a light bulb 17 normally seats when operatively disposed within the socket 12. The light bulb 17 has a pair of conductive leads which connect to a filament contained within a glass envelope. The chip 10 may include operatively connected conductive leads 18, wherein one lead 18 extends from each side 20 and 22 of the chip 10 and can be bonded thereto by a conductive epoxy, for example. A terminal end 24 of each lead 18 is configured to be operatively received into the plug-in socket surfaces 16. The leads 18 can be of a suitable conductive material such as copper.

Figure 2:
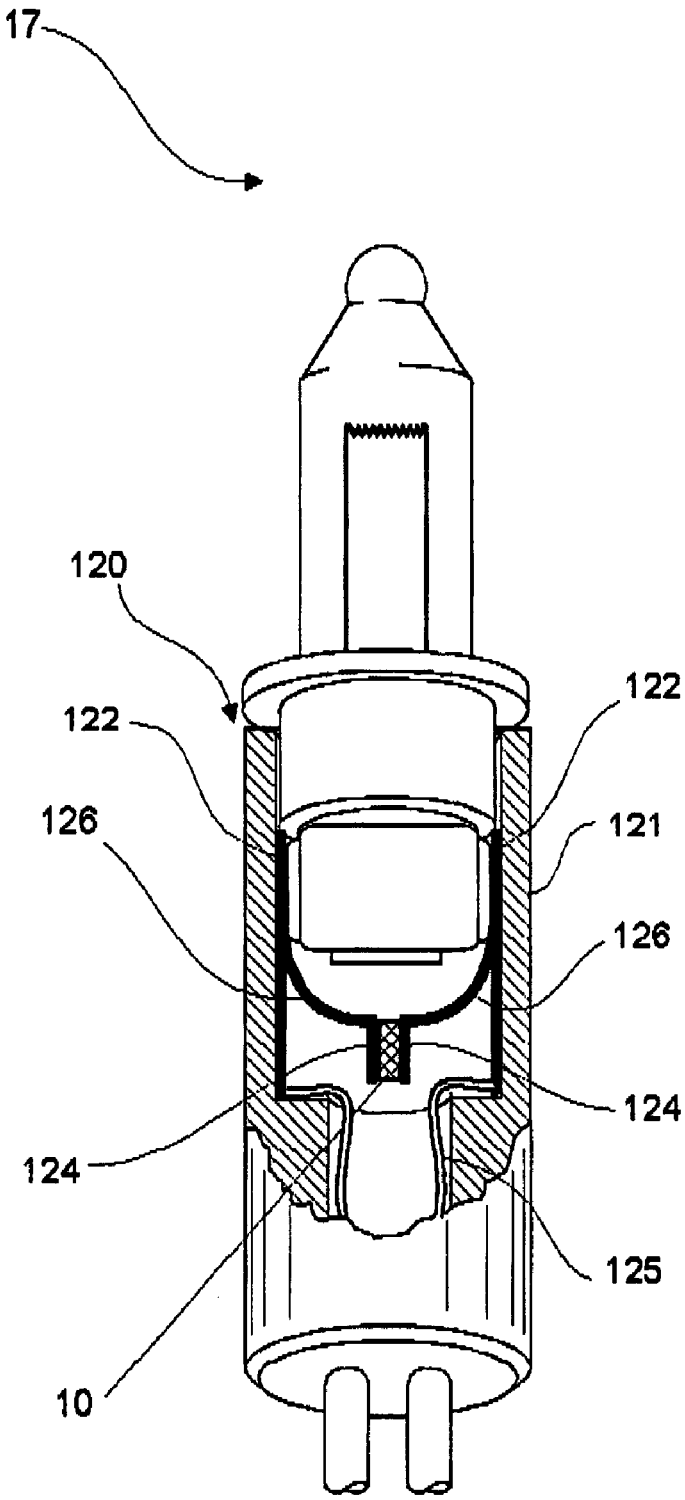
FIG. 2 is a partial sectional view of another embodiment.

FIG. 2 shows an alternative embodiment wherein the semiconductor chip 10 is bonded to bent conductive members 126 which each have an inwardly disposed flange 124. The socket 120 has a housing 121 to receive the light bulb 17 and a pair of opposing conductive terminals 122. The terminals 122 are connected to wires 125 which operatively extend outside the housing 120. The chip 10 can be bonded, e.g., with an epoxy, to flange 124. When operatively disposed, the chip 10 is disposed adjacent and between the flanges 124.

Figure 3:
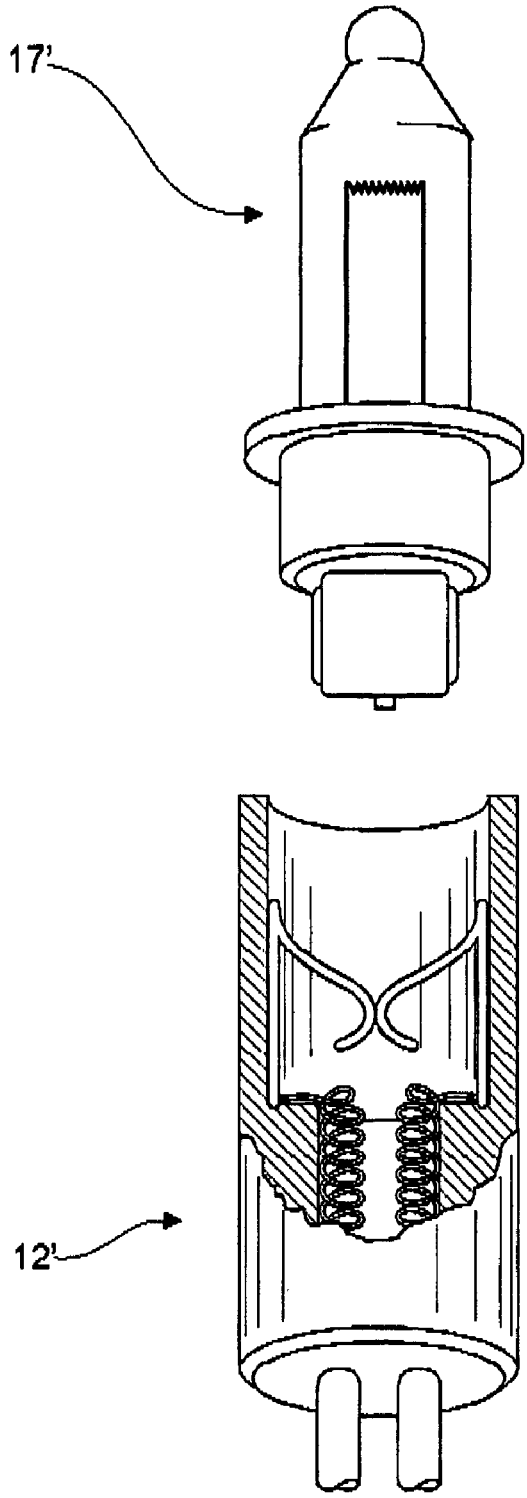
FIG. 3 is a partial sectional view of an existing socket.

FIG. 3 shows an existing socket 12' and bulb 17'. The socket 12' shorts when the bulb 17' is removed.

Figure 4A:
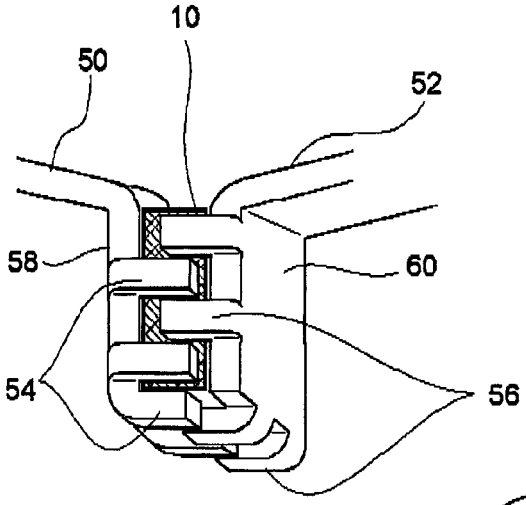
FIG. 4*a* is a blow up of a part of FIG. 4.
Figure 4:
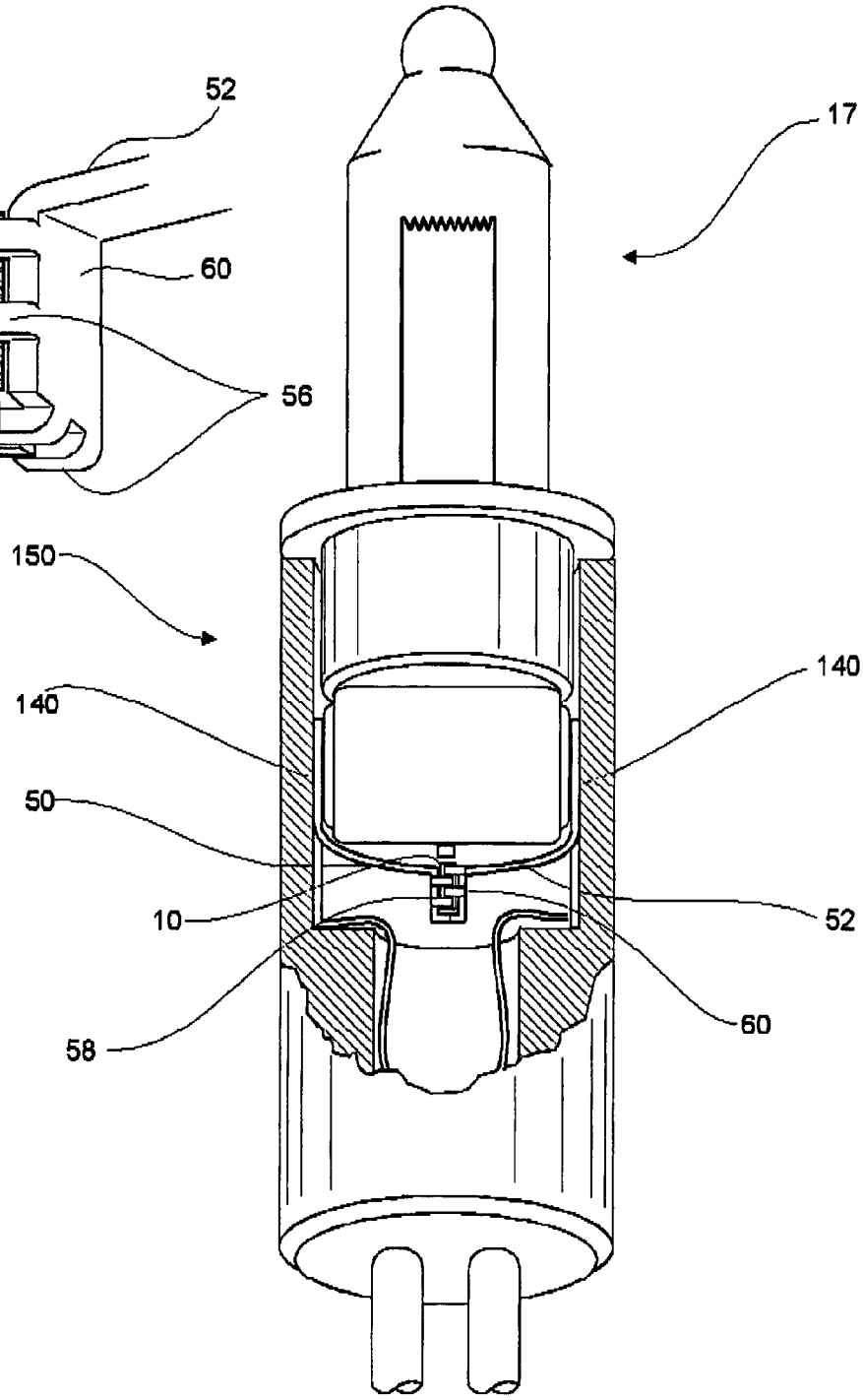
FIG. 4 is a partial sectional view of yet another embodiment of the invention.

In yet another embodiment, FIG. 4 shows bent conductive terminals 50 and 52 having retention fingers 54 and 56, respectively, which are opposing each other in a spaced relationship such that the fingers 54 and 56 do not touch. The terminals 50 and 52 contact conductive terminals 140. The fingers 54 and 56 can be set at an angle to aid in this regard. When operatively disposed in socket 150, the fingers 54 and 56 form part of a retaining seat for chip 10 along with lower portions 58 and 60 of the terminals 50 and 52, respectively. The chip 10 can be inserted between terminals 50 and 52 so that the terminals 50 and 52 do not touch.

Figure 5:
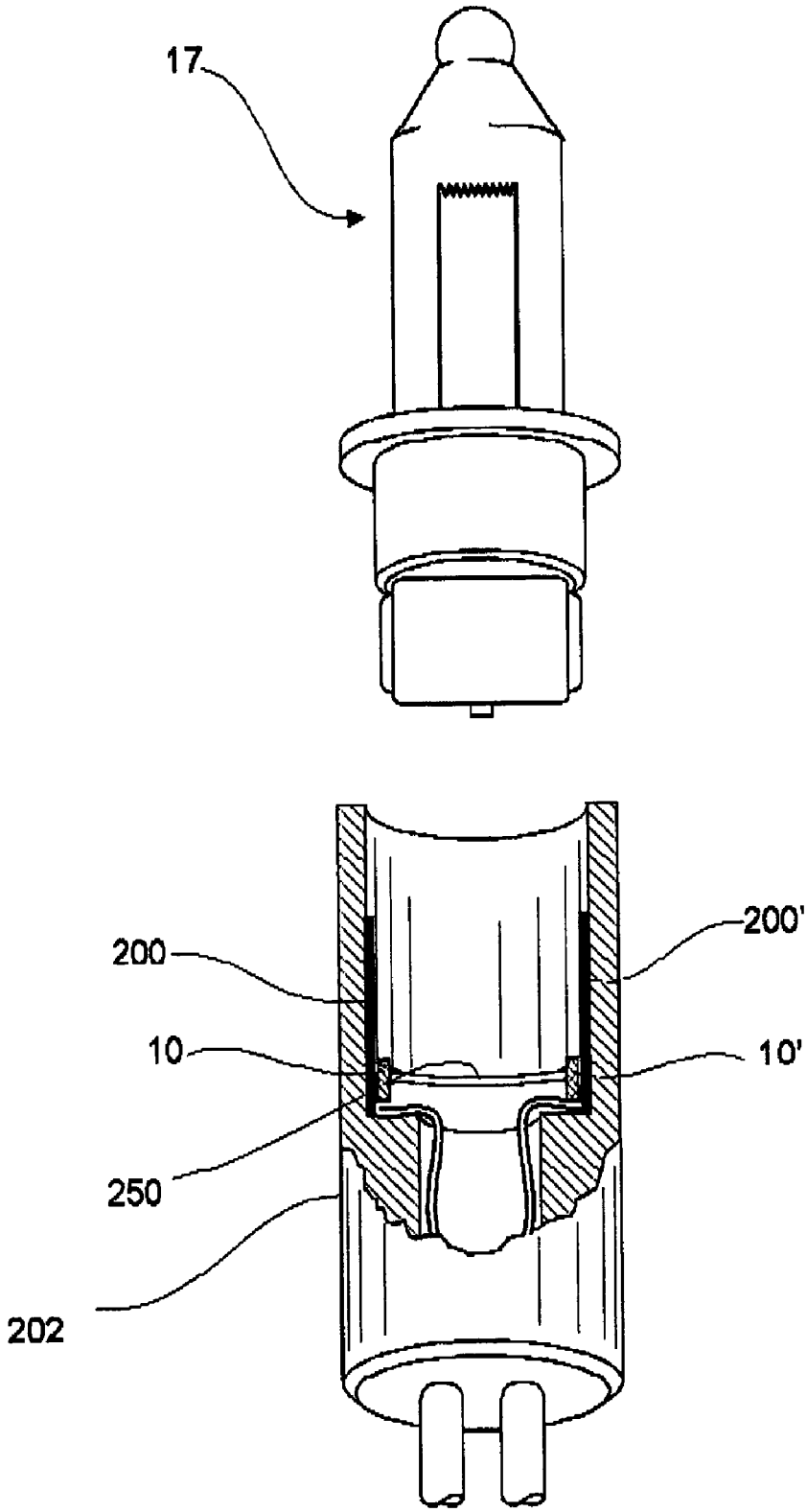
FIG. 5 is a partial sectional view of still another embodiment of the invention.

Still another embodiment shown in FIG. 5 provides for chips 10 and 10' to be conductively directly connected to conductive terminals 200 and 200' within socket 202. Again, the chips 10 and 10' can be bonded directly to the terminals 200 and 200' on one side. A conductive wire 250 interconnects the two chips 10 and 10' and likewise the ends of the wire 250 can be press fit between (and optionally bonded) to the other side of each respective chip 10 and 10'. Each chip 10 and 10' is intended to dissipate half of the power keeping the socket 202 from overheating in cases where too much current is drawn, such as when higher watt light bulbs are used.

Figure 6:
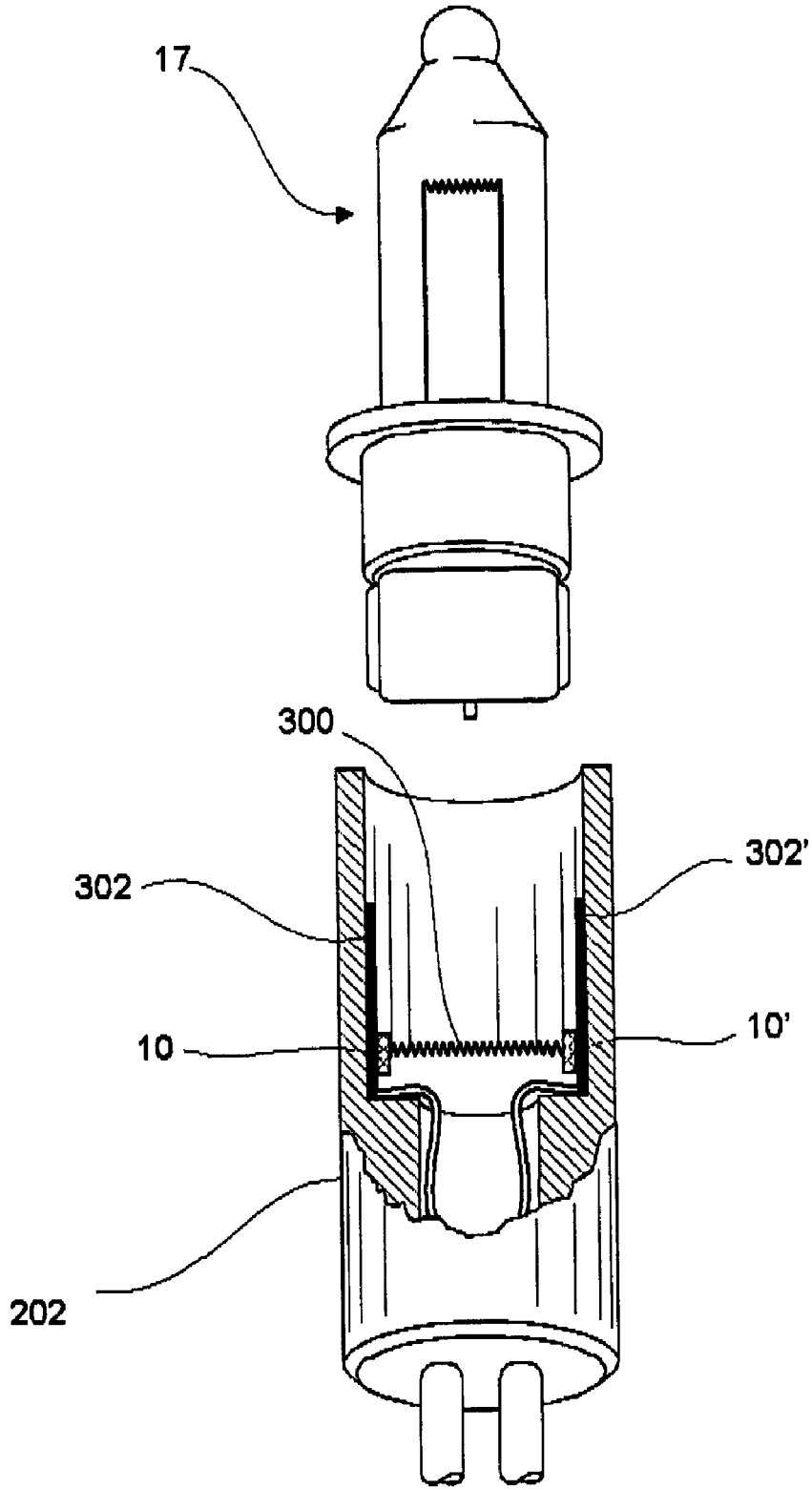
FIG. 6 is a partial sectional view of another embodiment of the invention.

FIG. 6 shows another embodiment. Here, the operation is similar to that of FIG. 5. However, a conductive compression spring 300 is used to connect chips 10 and 10' with each end of the spring 300 conductively connected to one side of the respective chips 10 and 10'. The spring 302 is configured to bias the chips 10 and 10' into retained conductive contact with terminals 302 and 302' in socket 350 below where the light bulb 17 is operatively seated. Once operatively disposed in the socket 350, the chips 10 and 10' can be bonded to the terminals 302 and 302', if desired, or contact allowed to be made by the compression spring 300.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A shunt device for use in a light socket in a light string having at least two said light sockets connected in series, wherein each said socket receives a light bulb, wherein said socket includes a housing having a pair of conductive terminals to operatively connect and receive part of a light bulb in an upper portion of the housing and leaving a lower portion of said housing unoccupied by the light bulb, and each terminal is operatively connected to a wire leading outside the housing, which includes:

a first semiconductor chip; and a first conductive member connected at one end to one side of said first semiconductor chip and having another end, and wherein said chip and said member are configured to be operatively interposed in a self retained manner between the terminals in the lower portion of the housing, wherein said first conductive member is a spring.

2. The shunt device of claim 1, wherein said first conductive member is bonded to said side of said chip.

3. The shunt device of claim 1, which further includes a second semiconductor chip wherein said first conductive member is connected at said another end to another side of said second chip and wherein said chips contact said terminals when said chips and said conductive member are configured to be operatively interposed between said terminals in said lower portion.

4. The shunt device of claim 3, wherein said first conductive member is bonded to each said chip.

5. The shunt device of claim 4, wherein each said chip is bonded to said terminal.

6. A light socket for use with a light string having at least two said light sockets connected in series, wherein each said socket receives a light bulb, wherein said socket includes:

a housing having a pair of conductive terminals to operatively connect and receive part of a light bulb in an upper portion of the housing and leaving a lower portion of said housing unoccupied by said light bulb, said terminals each having a plug-in socket surface formed therein which reside in said lower portion of said housing, and each said terminal operatively connected to a wire leading outside said housing; and a semiconductor chip having a first conductive lead connected to one side thereof and having a terminal end configured to plug into one of said plug-in socket surfaces and a second conductive lead connected to another side of said chip and having a terminal end configured to plug into another of said plug-in socket surfaces.

7. The light socket of claim 6, wherein said leads are bonded to said sides of said chip.

8. A light socket for use with a light string having at least two said light sockets connected in series, wherein each said socket receives a light bulb, wherein said socket includes:

a housing having a pair of conductive terminals to operatively connect and receive part of the light bulb in an upper portion of the housing and leaving a lower portion of said housing unoccupied by the light bulb, and each said terminal operatively connected to a wire leading outside said housing; and a first semiconductor chip having a first conductive member connected at one end to one side thereof and having another end, and wherein said chip and member are configured to be operatively interposed between said terminals in said lower portion, and wherein said first conductive member is a spring.

9. The light socket of claim 8, wherein said first conductive member is bonded to said side of said chip.

10. The light socket of claim 8, which further includes a second semiconductor chip wherein said first conductive member is connected at said another end to another side of said chip and wherein said chips contact said terminals when operatively interposed between said terminals in said lower portion.

11. The light socket of claim 10, wherein said first conductive member is bonded to each said chip.

12. The light socket of claim 10, wherein each said chip is bonded said terminal.

13. A shunt device for use in a light socket for use with a light string having at least two said light sockets connected in series, wherein each said socket receives a light bulb, wherein said socket includes a housing having a pair of conductive terminals to operatively connect and receive part of the light bulb in an upper portion of the housing and leaving a lower portion of said housing unoccupied by the light bulb, wherein each terminal includes a bent portion extending into the lower portion of the housing which bias toward one another, and each terminal is operatively connected to a wire leading outside the housing, which includes:

a first semiconductor chip; and a bent conductive member having said chip connecting to one end and which is configured for the semiconductor chip to be inserted between the bent portion of each terminal and with another end of the bent member serving to retain the member and chip between the conductive terminals in the lower portion of the housing.

14. A light socket for use with a light string having at least two said light sockets connected in series, wherein each said socket receives a light bulb, wherein said socket includes:

a first semiconductor chip; and a housing having a pair of conductive terminals to operatively connect and receive part of the light bulb in an upper portion of the housing and leaving a lower portion of said housing unoccupied by the light bulb, and each said terminal operatively connected to a wire leading outside said housing and having a terminating end within the lower portion which includes retention fingers which are opposing each other in a spaced relationship in a manner to form a retaining seat for said chip disposed between the fingers.

15. The light socket of claim 14, wherein said chip is bonded between said fingers of said terminals.

* * * * *